US006799012B2

(12) United States Patent
Shakuto et al.

(10) Patent No.: US 6,799,012 B2
(45) Date of Patent: Sep. 28, 2004

(54) CLEANING DEVICE AND IMAGE FORMING APPARATUS USING THE SAME

(75) Inventors: Masahiko Shakuto, Kanagawa (JP); Yasushi Nakazato, Tokyo (JP); Osamu Naruse, Kanagawa (JP); Naomi Sugimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/143,928

(22) Filed: May 14, 2002

(65) Prior Publication Data

US 2002/0181983 A1 Dec. 5, 2002

(30) Foreign Application Priority Data

May 18, 2001 (JP) ..... 2001-149701

(51) Int. Cl.[7] ..... G03G 21/00
(52) U.S. Cl. ..... 399/357; 399/358
(58) Field of Search ..... 399/343, 353, 399/354, 357, 358, 344; 15/256.51, 256.52

(56) References Cited

U.S. PATENT DOCUMENTS

| | | | | |
|---|---|---|---|---|
| 5,128,725 A | * | 7/1992 | Frankel et al. | 399/347 |
| 5,148,227 A | * | 9/1992 | Senba et al. | 399/349 |
| 5,260,754 A | | 11/1993 | Yano et al. | 399/123 |
| 5,386,274 A | | 1/1995 | Sanpe et al. | 399/101 |
| 5,526,100 A | | 6/1996 | Misago et al. | 399/29 |
| 5,592,267 A | | 1/1997 | Misago et al. | 399/62 |
| 5,606,408 A | | 2/1997 | Yano et al. | 399/363 |
| 5,619,316 A | * | 4/1997 | Shoji et al. | 399/359 |
| 5,638,159 A | | 6/1997 | Kai et al. | 399/253 |
| 5,740,494 A | | 4/1998 | Shoji et al. | 399/71 |
| 5,765,087 A | | 6/1998 | Yano et al. | |
| 6,505,014 B2 | | 1/2003 | Aoki et al. | 399/55 |
| 6,537,716 B1 | * | 3/2003 | Doi et al. | 430/108.23 |

FOREIGN PATENT DOCUMENTS

| | | |
|---|---|---|
| JP | 56-30868 | 7/1981 |
| JP | 6-51579 | 2/1994 |
| JP | 7-155222 | 6/1995 |
| JP | 8-314349 | 11/1996 |
| JP | 2000-75755 | 3/2000 |
| JP | 2000-292982 | 10/2000 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A cleaning device of the present invention is configured to remove toner left on an image carrier after the transfer of a toner image from the image carrier to a recording medium. A rotatable cleaning roller contacts the image carrier for removing the toner left on the image carrier. A rotatable brush roller is positioned upstream of the cleaning roller in the direction of rotation of the image carrier and rubs against the surface of the image carrier and that of the cleaning roller. The cleaning device is free from defective cleaning despite the use of spherical, dry toner grains capable of forming high-quality toner images.

25 Claims, 12 Drawing Sheets

FIG. 7

| NUMBER OF ROTATIONS (K) | FLAT EDGE 4a | | RUGGED EDGE 4b | | SAW-TOOTHED EDGE 4c | |
|---|---|---|---|---|---|---|
| | TONER REMOVAL | BRUSH DURABILITY | TONER REMOVAL | BRUSH DURABILITY | TONER REMOVAL | BRUSH DURABILITY |
| 0~5 | ○ | ○ | ○ | ○ | ○ | ○ |
| 5~10 | ○ | ○ | ○ | ○ | ○ | ○ |
| 10~20 | ○ | ○ | ○ | ○ | ○ | ○ |
| 20~40 | ○ | ○ | ○ | ○ | ○ | ○ |
| 40~60 | × | ○ | ○ | ○ | ○ | ○ |
| 60~80 | × | ○ | ○ | ○ | ○ | ○ |
| 80~100 | × | ○ | × | ○ | ○ | ○ |

○ : GOOD

× : NO GOOD

FIG. 11

| NUMBER OF PRINTS (K) | IMAGE FORMING APPARATUS 100 | | | CONVENTIONAL IMAGE FORMING APPARATUS | | |
|---|---|---|---|---|---|---|
| | DEFECTIVE CLEANING | FILMING | DRUM DURABILITY | DEFECTIVE CLEANING | FILMING | DRUM DURABILITY |
| 0~10 | O | O | O | O | O | O |
| 10~20 | O | O | O | O | O | O |
| 20~40 | O | O | O | × | O | O |
| 40~100 | O | O | O | × | × | O |
| 100~150 | O | O | O | × | × | O |
| 150~200 | O | O | O | × | × | O |
| 250~300 | O | O | O | × | × | O |

O : GOOD

× : NO GOOD

CLEANING DEVICE AND IMAGE FORMING APPARATUS USING THE SAME

BACKGROUND OF THE INVENTION

1. Field of the Invention

The present invention relates to a cleaning device for removing toner left on an image carrier after the transfer of a toner image from the image carrier to a sheet or recording medium, and a copier, facsimile apparatus, printer or similar electrostatic image forming apparatus using the same.

2. Description of the Background Art

Today, there is an increasing demand for high-quality toner images available with an electrostatic image forming apparatus. Small size, spherical toner grains effectively enhance image quality, as recently reported in the imaging art. As for full-color images, gloss contributes a great deal to image quality, as also reported in the imaging art. Small size, spherical, dry toner grains with a narrow grain size distribution have been reported to implement high quality and high gloss. However, small size, spherical, dry toner grains have some problems left unsolved.

The most serious problem with the toner grains of the kind described is that it is difficult for a cleaning device to fully remove the toner grains left on an image carrier after image transfer, resulting in defective cleaning. Particularly, in a cleaning device of the type using a cleaning blade, toner gathers most densely at a nip between an image carrier and a cleaning blade during cleaning. As a result, a first toner layer strongly adhering to the image carrier and a second toner layer formed on the first layer slip on each other, so that the first layer remains on the image carrier.

Further, the blade of the cleaning device exerts a stress on wax dispersed in the toner grains. As a result, the wax comes out on the surfaces of the toner grains and deposit on the image carrier in the form of a film. The wax film reduces the frictional coefficient of the image carrier and therefore adhesion acting between the toner grains and the image carrier. In this condition, discharge is apt to transfer the toner grains from the image carrier to a sheet at a position short of the nip between them, resulting in an image with a dust-like defect.

In light of the above, a cleaning device with a cleaning roller or a cleaning brush has been proposed in various forms in the past. Japanese Patent Laid-Open Publication No. 2000-284664, for example, discloses a cleaning device including a collecting roller and a cleaning blade. In this cleaning device, the surface of a photoconductive drum is brought to a position spaced from the collecting roller by a preselected distance. At this position, the collecting roller collects normal toner grains left on the surface of the drum, allowing them to be used as recycled toner. Subsequently, the above surface of the drum is brought into contact with the cleaning blade. The cleaning blade removes toner grains also left on the drum, but reduced in size, for thereby distinguishing waste toner grains from the normal toner grains.

Japanese Patent Laid-Open Publication No. 5-188836 teaches a cleaning device of the type including a cleaning brush and a cleaning roller to each of which a particular voltage is applied. Toner collected by the cleaning brush from a photoconductive drum is transferred to the cleaning roller. A magnetic body is disposed in the cleaning roller below a horizontal plain containing the axis of the roller and spaced from the inner periphery of the roller by a preselected distance. The magnetic body may alternatively be implemented as a magnetic blade whose edge faces the cleaning roller. The magnetic blade removes toner from the cleaning roller being rotated. The above document describes that this type of developing device prevents image quality from being lowered and achieves a long life.

Further, Japanese Patent Laid-Open Publication No. 6-167912 proposes a cleaning device including a cleaning brush for collecting dust and a collecting roller for collecting the dust from the cleaning brush. When the cleaning device is not in operation, the cleaning brush is spaced from a portion to be cleaned and is rotated in a direction opposite to a direction assigned to cleaning. The document describes that this configuration prevents dust deposited on the cleaning brush from flying out of the cleaning device and extends the life of the cleaning brush.

However, in any one of the prior art cleaning devices described above, the ability of the cleaning roller or that of the cleaning brush falls due to aging although it may be desirable in the initial stage of use. More specifically, as the cleaning operation is repeated, the toner accumulates on the cleaning roller or fills interstices between the filaments of the cleaning brush to thereby reduce the diameter of the brush. In such a condition, the cleaning roller or the cleaning brush loses the expected cleaning ability.

Technologies relating to the present invention are also disclosed in, e.g., Japanese Patent Publication No. 56-30868 and Japanese Patent Laid-Open Publication Nos. 6-51579, 7-155222, 8-314349, 2000-75755, and 2000-292982.

SUMMARY OF THE INVENTION

It is an object of the present invention to provide a cleaning device capable of removing even small size, spherical, dry toner grains left on an image carrier after image transfer to thereby obviate defective cleaning, and an image forming apparatus using the same.

A cleaning device of the present invention is configured to remove toner left on an image carrier after the transfer of a toner image from the image carrier to a recording medium. A rotatable cleaning roller contacts the image carrier for removing the toner left on the image carrier. A rotatable brush roller is positioned upstream of the cleaning roller in the direction of rotation of the image carrier and rubs against the surface of the image carrier and that of the cleaning roller.

An image forming apparatus using the above cleaning device is also disclosed.

BRIEF DESCRIPTION OF THE DRAWINGS

The above and other objects, features and advantages of the present invention will become more apparent from the following detailed description taken with the accompanying drawings in which:

FIG. 7 is a table comparing the configurations of FIGS. 4 through 6 as to cleaning ability and brush durability;

FIG. 11 is a table comparing, based on experimental results, the image forming apparatus of FIG. 10 and a conventional image forming apparatus simply using a cleaning blade.

DESCRIPTION OF THE PREFERRED EMBODIMENT

Figure 1:
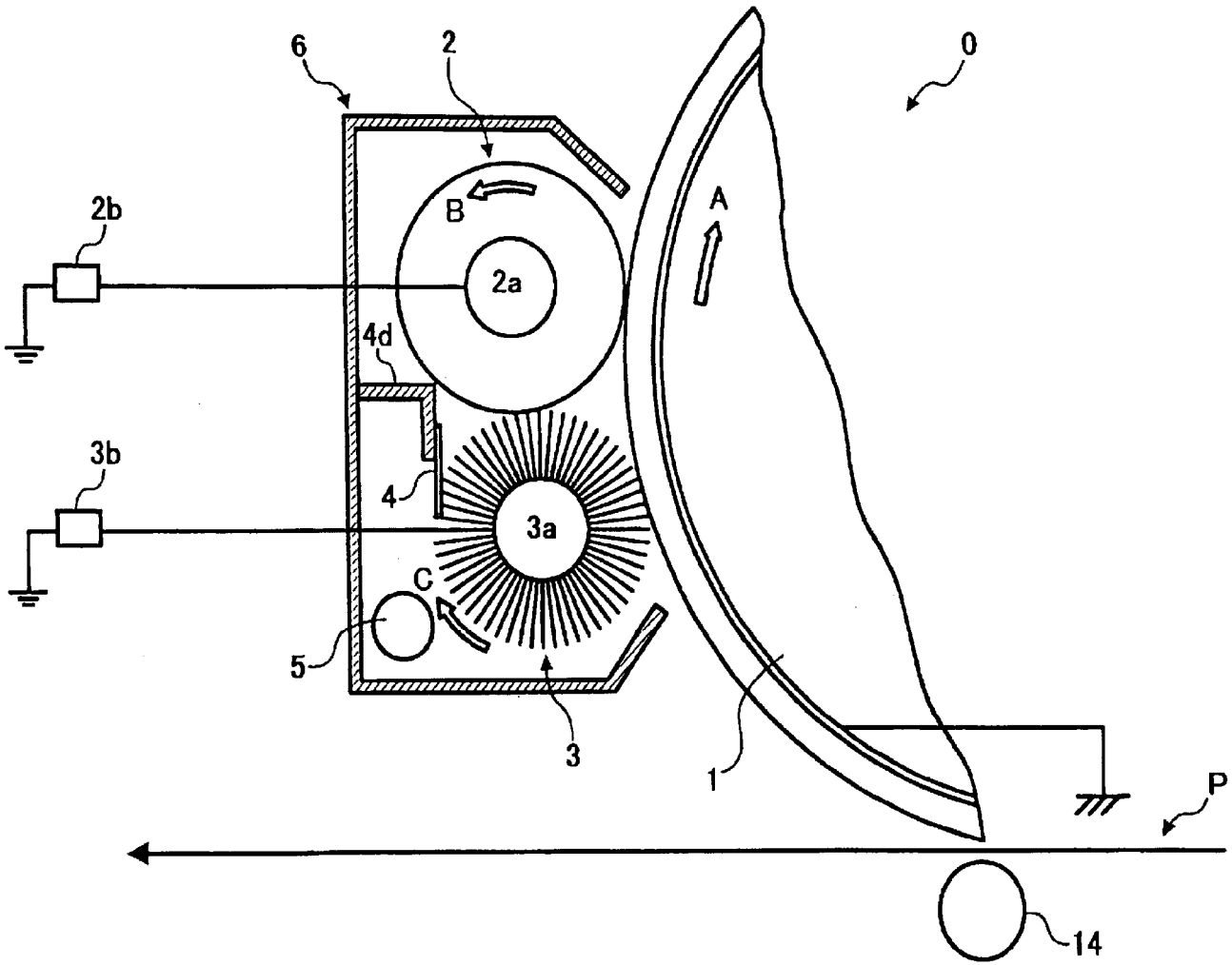
FIG. 1 is a view showing a cleaning device embodying the present invention.

Referring to FIG. 1 of the drawings, a cleaning device embodying the present invention is shown and generally designated by the reference numeral 0. As shown, the cleaning device 0 removes toner left on a photoconductive drum or image carrier 1 after the transfer of a toner image from the drum 1 to a sheet P. The drum 1 is rotatable in a direction indicated by an arrow A in FIG. 1. The cleaning device 0 includes a cleaning roller 2 and a brush roller 3. The cleaning roller 2 contacts the drum 1 and rotates in a direction indicated by an arrow B opposite to the direction A, thereby removing toner left on the drum 1 after image transfer. The brush roller 3 is positioned upstream of the cleaning roller 2 in the direction A and rotates in a direction C identical with the direction A in contact with the cleaning roller 2. The toner may be implemented as spherical, dry grains having a small grain size each.

The cleaning roller 2 and brush roller 3 are accommodated in a cover 6. The cleaning roller 2 and brush roller 3 cooperate to remove the toner left on the drum 1 after image transfer. The brush roller 3 therefore remove the toner from both of the drum 1 and cleaning roller 2 for thereby surely removing the toner and obviating defective cleaning.

A bracket 4*d* is mounted on the cover 6 and supports a scraper blade 4. The scraper blade 4 removes the toner collected by the brush roller 3. A screw conveyor or conveying means 5 conveys the toner accumulated in the cover 6 to a waste toner bottle, not shown, as waste toner. The waste toner may be collected by a service person or may be returned on a developing device 13 (see FIG. 10) as recycled toner.

The cleaning roller 2 includes a core 2*a* and an elastic, conductive layer 2*c* formed on the core 2*a*. The elastic conductive layer consists of polyurethane rubber, silicone rubber, butadiene rubber or similar elastic material and conductive, fine grains dispersed in the elastic material. The conductive fine grains may be implemented by an oxide of carbon black, titanium, aluminum or similar metal or an ion conducting agent by way of example. The cleaning roller 2 and drum 1 form a uniform nip therebetween. An electric field formed at the nip allows the cleaning roller 2 to electrostatically attract the toner from the drum 1.

Further, a medium resistance layer 2*d* forms the surface of the cleaning roller 2 in order to prevent a bias current from leaking via pin holes existing in the surface of the roller 2. In addition, a surface protection layer 2*e* may be formed on the medium resistance layer for protecting the surface of the cleaning roller 2 from contamination. Such layers laminated on the cleaning roller 2 obviate defective cleaning more positively.

In the illustrative embodiment, the cleaning roller 2 has a diameter of 16 mm. The core 2*a* has a diameter of 6 mm and a volume resistivity of $10^6$ Ω·cm to $10^{12}$ Q·cm.

A power supply 2*b* is connected to the core 2*a* and applies a voltage to the cleaning roller 2. The cleaning roller 2 therefore electrostatically collects the toner left on the drum 1 while being rotated by drive means, not shown, in the direction B. Assume that the surface of the cleaning roller 2 moves in the direction counter to the direction in which the surface of the drum 1 moves, as seen at the nip. Then, part of the toner that the brush roller 3 failed to remove from the cleaning roller 2 is brought to a wedge-shaped region downstream of the cleaning roller 2 and again caused to deposit on the drum 1 either electrostatically or mechanically. The drum 1 directly conveys such toner to a charger not shown.

By contrast, in the illustrative embodiment, the surface of the cleaning roller 2 moves in a trailing direction, i.e., in the same direction as the surface of the drum 1, as seen at the nip. Therefore, the toner not removed by the brush roller 3 is moved to a position upstream of the cleaning roller 2 and again acted on by the roller 2. The cleaning device can therefore surely remove the toner from the drum 1.

The brush roller 3 positioned upstream of the cleaning roller 2 in the direction A contacts both of the cleaning roller 2 and drum 1. A power supply 3*b* applies a voltage to a core 3*a* included in the brush roller 3, so that the brush roller 3 can electrostatically collect the toner. The brush roller 3 rotates in the direction C opposite to the direction B of rotation of the cleaning roller 2 at a preselected peripheral speed.

In the illustrative embodiment, the core 3*a* of the brush roller 3 is formed of a metal and has a diameter of 6 mm. A brush on the core 3*a* is implemented as a tape of pile spirally wrapped around the core 3*a*. The tape of pile is constituted by 3 denier, conductive rayon filaments distributed by an amount of 200,000 filaments for an inch. The brush roller 3 with such a configuration has a diameter of 16 mm.

Generally, when the toner stored in the developing device 13 is chargeable to negative polarity by way of example, a positive voltage or a positive current is applied to an image transferring device 14 (see FIG. 10) to thereby transfer the toner from the drum 1 to the sheet P. Therefore, when the sheet P is peeled off the drum 1, the resulting discharge reversely charges the toner left on the drum 1 to positive polarity. However, not the entire toner left on the drum 1 is uniformly charged to positive polarity, but the toner is irregularly charged to positive polarity or even some toner remains charged to negative polarity.

In light of the above, in the illustrative embodiment, the power supply 2*b* applies a voltage of 300 V to 500 V to the core 2*a* of the cleaning roller 2. Also, the power supply 3*b* applies a voltage of −300 V to −500 V to the core 3*a* of the brush roller 3. In this condition, the brush roller 3 collects the toner left on the drum 1 with positive polarity, and then the cleaning roller 2 collects the toner with negative polarity also left on the drum 1. In the illustrative embodiment, the brush roller 3 rotates at the same speed as the drum 1.

Figure 2:
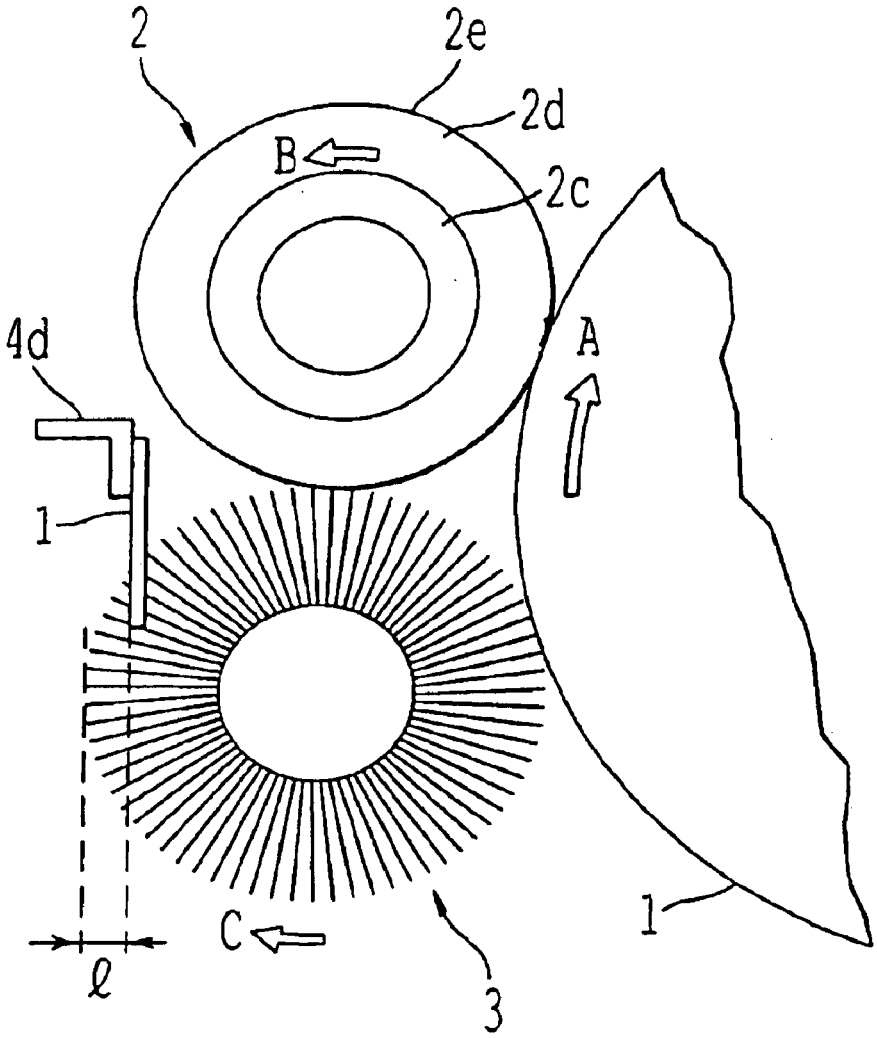
FIG. 2 is a fragmentary view showing a specific configuration of part of the illustrative embodiment.
Figure 3:
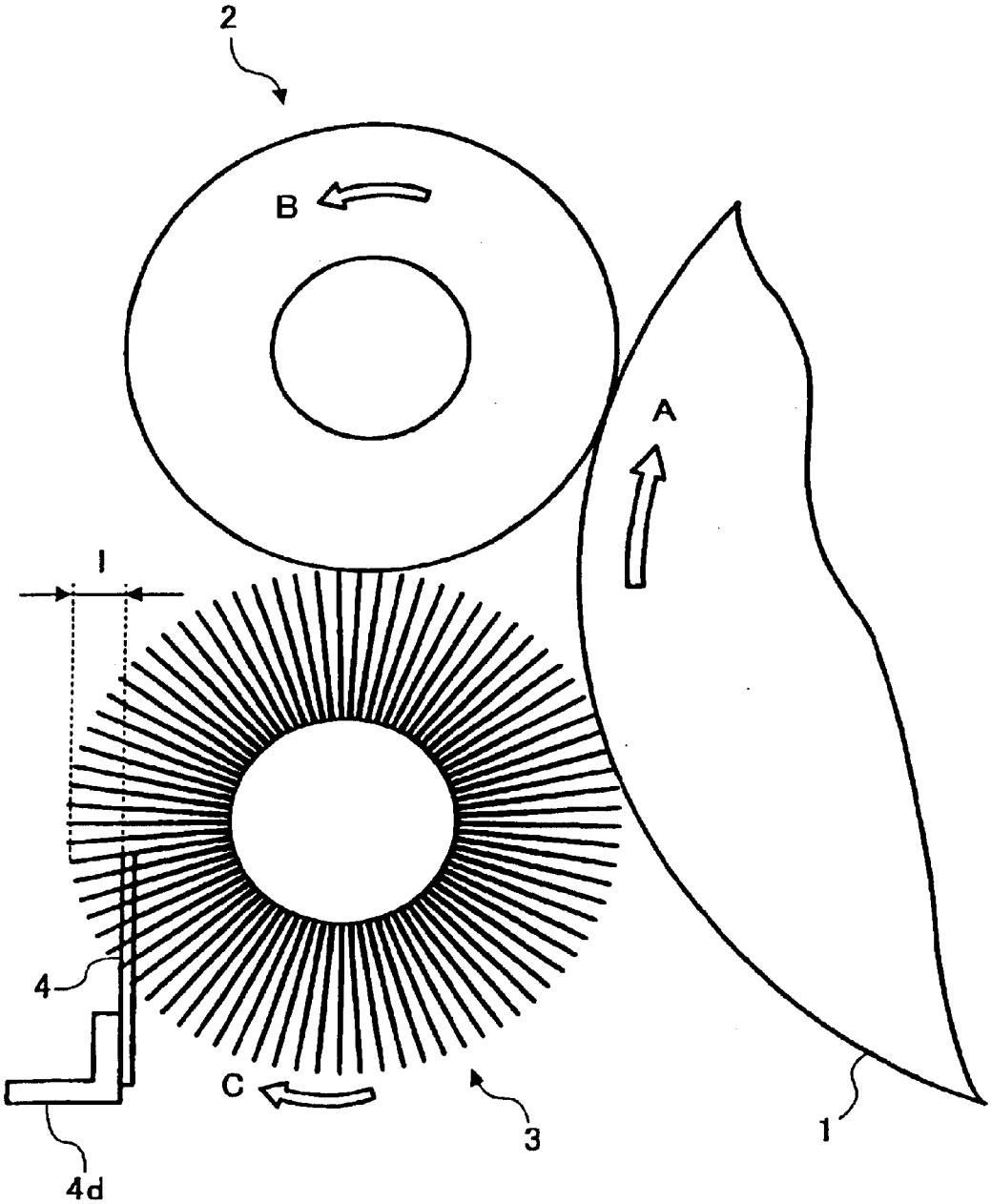
FIG. 3 is a view similar to FIG. 2, showing another specific configuration of the same part of the illustrative embodiment.

As shown in FIGS. 2 and 3, the scraper blade 4 is adhered to the bracket 4*d* and penetrates into the brush roller 3 by an amount 1 in the direction C of rotation of the roller 3. The scraper blade 4 scrapes off the toner collected by the brush roller 3 from the drum 1 and cleaning roller 2. If the amount 1 is excessively great, then a load to act on the brush roller 3 increases and causes the filaments to fall down, thereby reducing the life of the brush roller 3, as determined by experiments. If the amount 1 is excessively small, then the scraper blade 4 fails to efficiently remove the toner from the brush roller 3 and brings about defective cleaning in the initial stage, as also determined by experiments. In the illustrative embodiment, the scraper blade 4 is implemented as a PET (polyethylene terephthalate) sheet having a width of 0.2 mm and a free length of 4 mm. The amount 1 is selected to be 2.0 mm. With this configuration, the scraper blade 4 can desirably remove the toner from the brush roller 3 with high durability.

Figure 4:
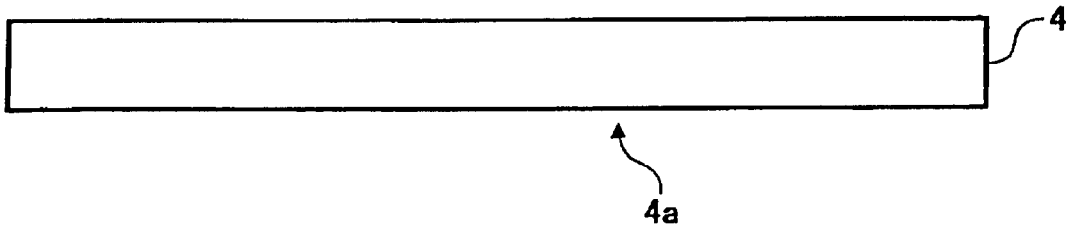
FIGS. 4, 5 and 6 are views each showing a particular configuration of the edge of a scraper blade included in the illustrative embodiment.
Figure 5:
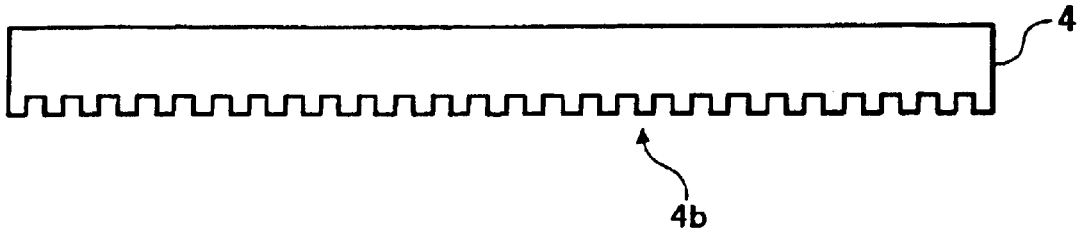
Figure 6:
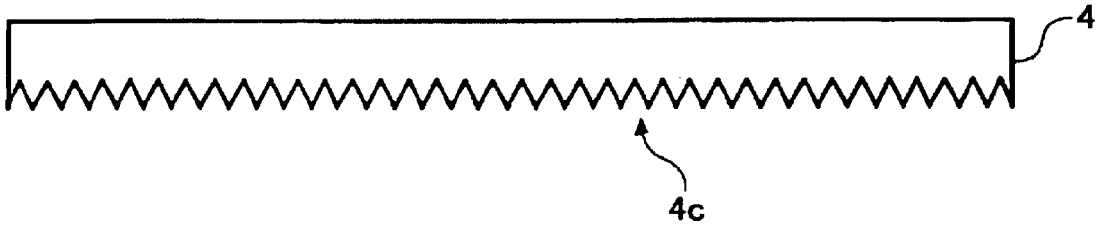
Figure 8A:
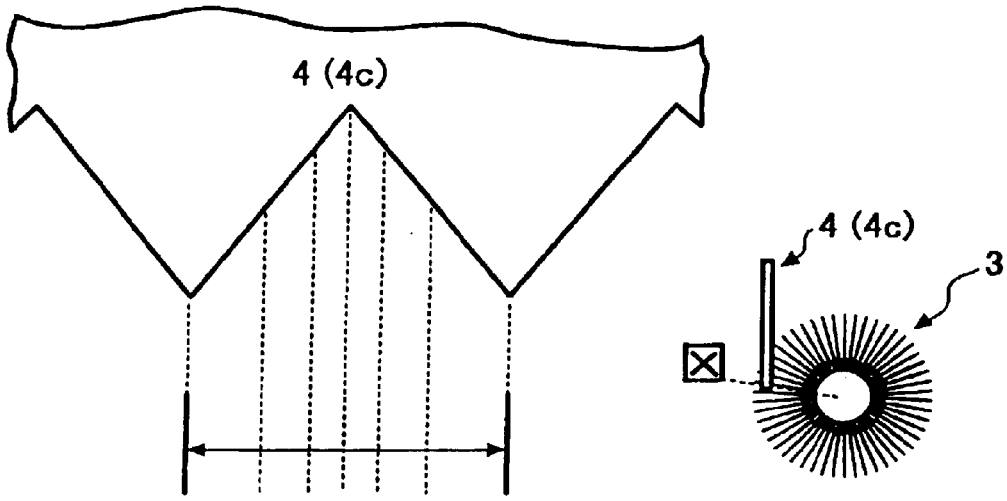
FIG. 8 demonstrates the operation of essential part of the illustrative embodiment.
Figure 8B:
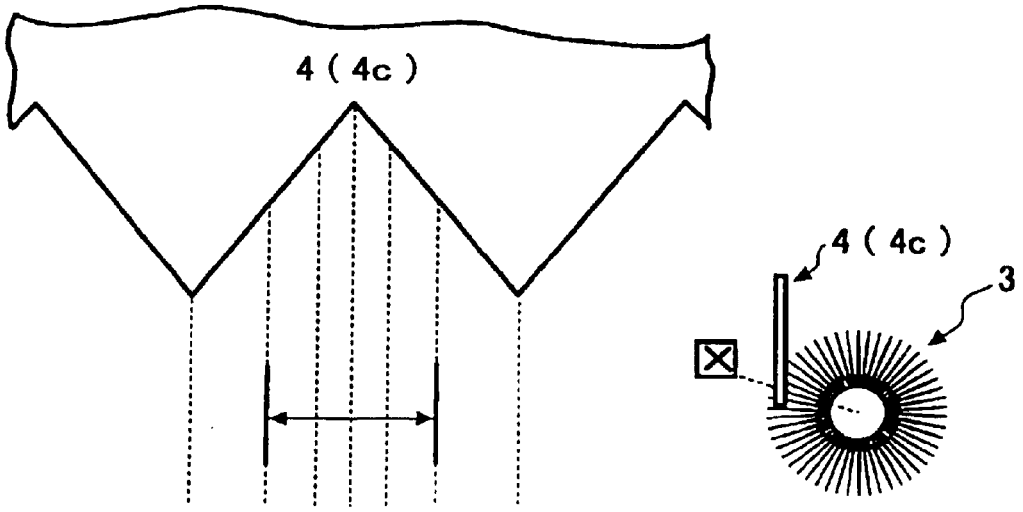
Figure 8C:
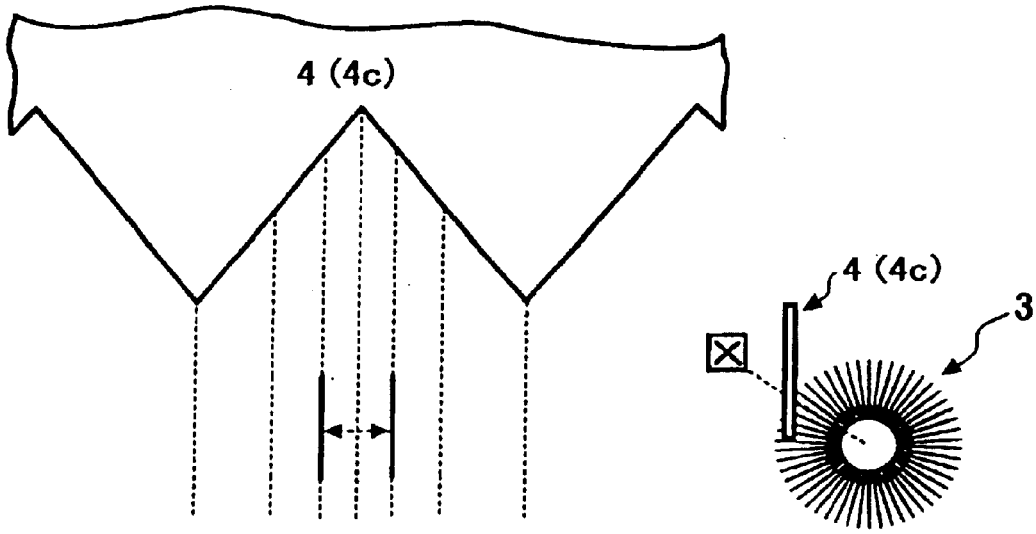
Figure 8D:
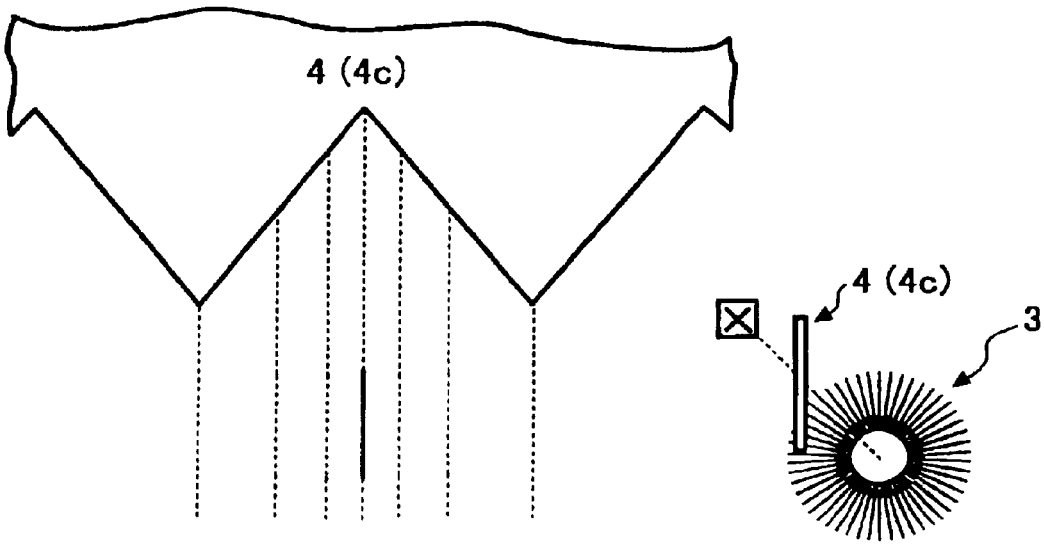
Figure 8E:
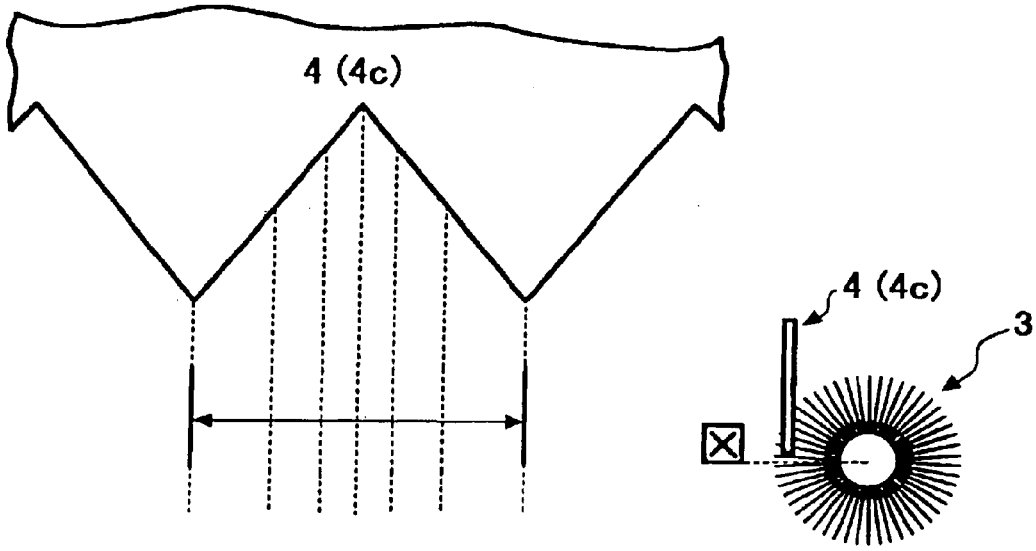

Some different shapes are applicable to the edge of the scraper blade 4 that contacts the brush roller 3. For example, FIGS. 4, 5 and 6 respectively show a flat edge 4*a*, a rugged edge 4*b*, and a saw-toothed edge 4*c*. FIG. 7 shows the results of experiments conducted to compare the three different edges 4*a*, 4*b* and 4*c* under the following conditions. The brush roller 3 was rotated 100,000 times in a leading type of arrangement (see FIG. 2) while being supplied with a preselected amount of toner.

As FIG. 7 indicates, the leading type of arrangement is advantageous over a trailing type of arrangement (see FIG. 3), which features high durability, as to the removal of toner from the initial stage. Also, the saw-toothed edge 4*c* is advantageous over the other edges 4*a* and 4*b* as to both of the removal of toner and durability. This is because the saw-toothed edge 4*c* contacts the brush of the brush roller 3 over a greater area than the other edges 4*a* and 4*b*.

More specifically, FIG. 8 shows the variation of width over which a given point X on the brush roller 3 contacts the scraper blade 4 having the saw-toothed edge 4*c* while in rotation. As shown, as the point X sequentially advances via positions (a), (b) and (c) in this order, the width over which the brush contacts the scraper blade 4 decreases little by little. Consequently, the brush densely gathers at the center portion and contacts the edge 4*c* with higher probability. The blade 4 can therefore surely remove the toner from the brush. Subsequently, when the point X moves from a position (d) to a position (e), the brush gathering at the center portion elastically restores its original shape at a time.

The toner to be dealt with by the cleaning device 0 is implemented as spherical, dry grains containing at least denaturated polyester with a urea bond as a toner binder. Wax is finely dispersed in each toner grain. The surface of a fixing member contacting a toner image, which is expected to have a gloss of 5% to 30%, has a surface temperature of 50° or above.

Denaturated polyester with a urea bond may be implemented by a reaction product of polyester prepolymer having an isocyanate radical and amine. Polyester prepolymer having an isocyanate radial may be a reaction product of polyester, which is a polymer of polyole and polycarboxylic acid and having an active hydrogen group, and polyisocyanate. The active hydrogen radical of the above polyester may be selected from a group of radicals including an alcoholic hydrogen radical, a phenolic hydrogen radical, an amino radical, a carboxyl radical, and melcapto group; the alcoholic hydrogen radical is more preferable than the others.

Figure 9:
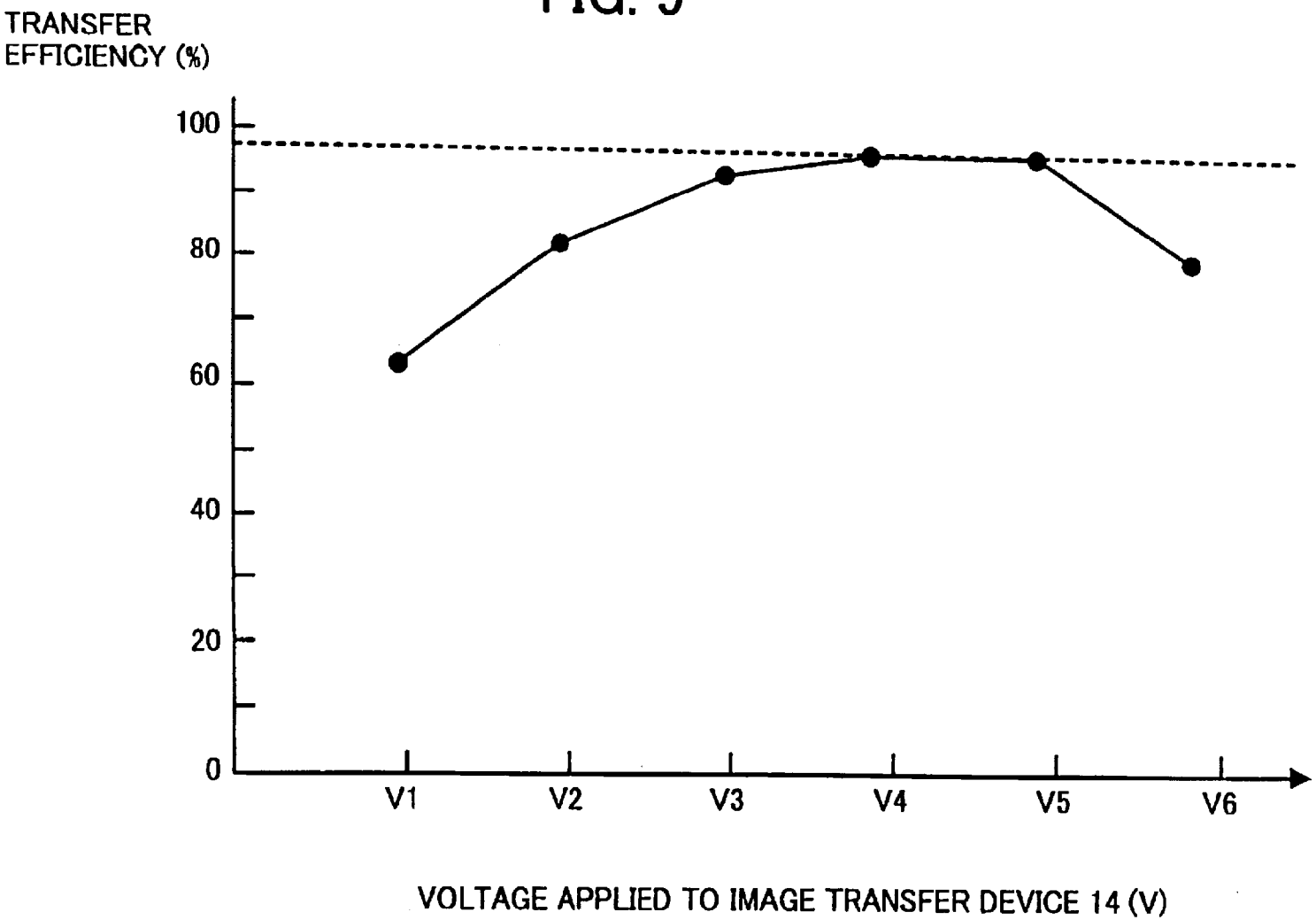
FIG. 9 is a graph showing a relation between image transfer efficiency and voltage applied to an image transferring device.

FIG. 9 shows a relation between the transfer efficiency (%) and the voltage (V) applied to the image transferring device 14 determined with the spherical, dry toner grains. As shown, a transfer efficiency close to 100% is achievable when an adequate voltage is applied to the image transferring device 14, leaving only a negligible amount of toner on the drum 1.

A conventional cleaning system using a cleaning blade has the following problem. During cleaning, toner gathers most densely at a nip between an image carrier and a cleaning blade. As a result, a first toner layer strongly adhering to the image carrier and a second toner layer formed on the first layer slip on each other, so that the first layer remains on the image carrier. The cleaning device of the illustrative embodiment is free from this problem, i.e., it allows a minimum amount of toner to remain on the drum 1 after image transfer despite the use of spherical, dry toner grains and therefore further enhances sure cleaning.

Further, the spherical, dry toner grains are desirable in durability against temperature, low-temperature fixing ability, and resistance to hot offset. Particularly, in the case of a full-color copier, such toner grains produces high-quality images desirable in color reproducibility, transparency, and stable gloss.

Figure 10:
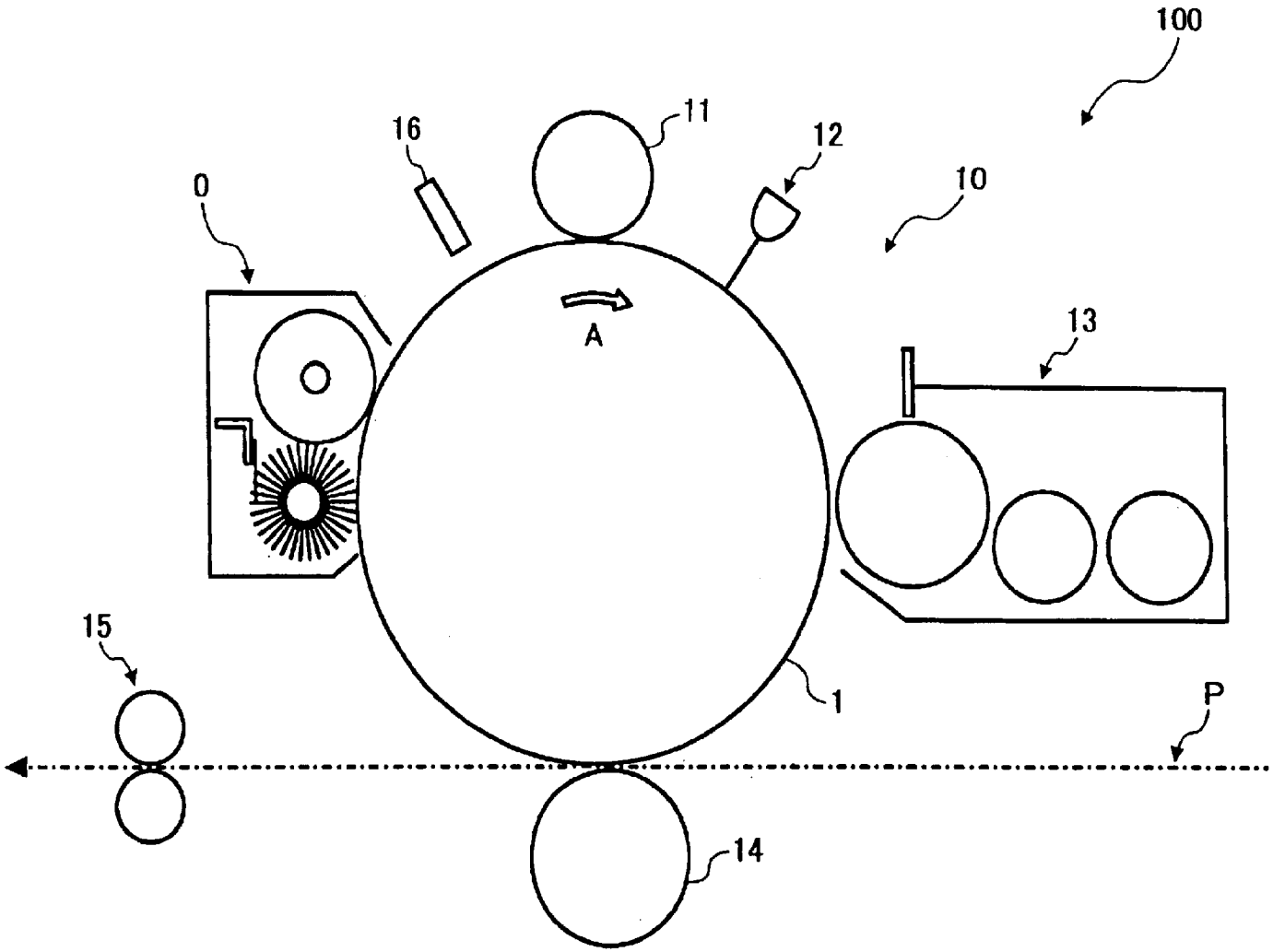
FIG. 10 is a view showing a specific configuration of an image forming apparatus including the cleaning device of the illustrative embodiment.

FIG. 10 shows an image forming apparatus 100 including the cleaning device 0 described above. As shown, a charger 11 uniformly charges the surface of the drum 1. A latent image forming device 12 forms a latent image on the charged surface of the drum 1. The developing device 13 develops the latent image with the spherical, dry toner grains to thereby produce a corresponding toner image. The image transferring device 14 transfers the toner image from the drum 1 to the sheet P. The cleaning device 0 removes the toner left on the drum 1 after the image transfer. The various devices 0 through 14 described above are constructed into a single image forming unit 10.

The drum 1 has a diameter of 60 mm and rotates at a speed of 300 mm/sec. In the illustrative embodiment, the drum 1 has an OPC (Organic PhotoConductor) layer chargeable to negative polarity. Of course, OPC may be replaced with an inorganic photoconductor or amorphous silicone by way of example.

The charger 11, which is implemented as a roller, contacts the drum 1 and is applied with a preselected voltage for uniformly charging the surface of the drum 1 to preselected polarity and preselected potential. If desired, the charger 11 may be implemented as a scorotron charger made up of a wire and a grid and spaced from the drum 1.

The latent image forming device 12 includes exposing means including a laser diode (LD) as a light-emitting device. The latent image forming device 12 scans the charged surface of the drum 1 in accordance with image data, thereby forming a latent image on the drum 1. The LD may, of course, be replaced with an LED (Light Emitting Diode) array, if desired.

In the illustrative embodiment, the voltage applied to the charger 11 is selected such that the potential on the drum 1 is initially −700 V and then reduced to −150 V by exposure.

The developing device 13 includes a rotatable sleeve or developer carrier, a stationary magnet roller disposed in the sleeve, and a screw conveyor for conveying a developer. In the illustrative embodiment, the developer is implemented as a toner and magnetic carrier mixture, i.e., a two-ingredient type developer that forms a magnet brush on the sleeve. Alternatively, use may be made of a one-ingredient type developer, i.e., toner only. A power supply, not shown, applies a bias for development to the sleeve. Charged toner is transferred from the sleeve to the drum 1 at a developing region to thereby develop the latent image.

The image transferring device 14 includes a transfer roller that is pressed against the drum 1 by a preselected pressure at the time of image transfer. A power supply, not shown, applies a voltage to the transfer roller. In this condition, the transfer roller transfers the toner image from the drum 1 to the sheet P at the nip between it and the drum 1. A fixing device 15 fixes the toner image on the sheet P. The sheet with the fixed toner image is driven out to a tray not shown. The transfer roller may also be replaced with a corotron charger or a belt.

A discharging device 16 discharges potential left on the drum 1 after image transfer and is implemented by an LED array.

Experiments were conducted to compare the image forming apparatus 100 and a conventional image forming apparatus simply including a cleaning blade with respect to cleaning ability. More specifically, durability tests were conducted to determine defective cleaning, filming, and the durability of an image carrier. FIG. 11 shows the results of experiments obtained when 300,000 prints were produced. As FIG. 11 indicates, the image forming apparatus 100 including the cleaning device 0 is superior to the conventional image forming apparatus in that it desirably removes the spherical, dry toner grains from the drum 1 and in that it obviates the filming of toner resin or that of wax.

Figure 12:
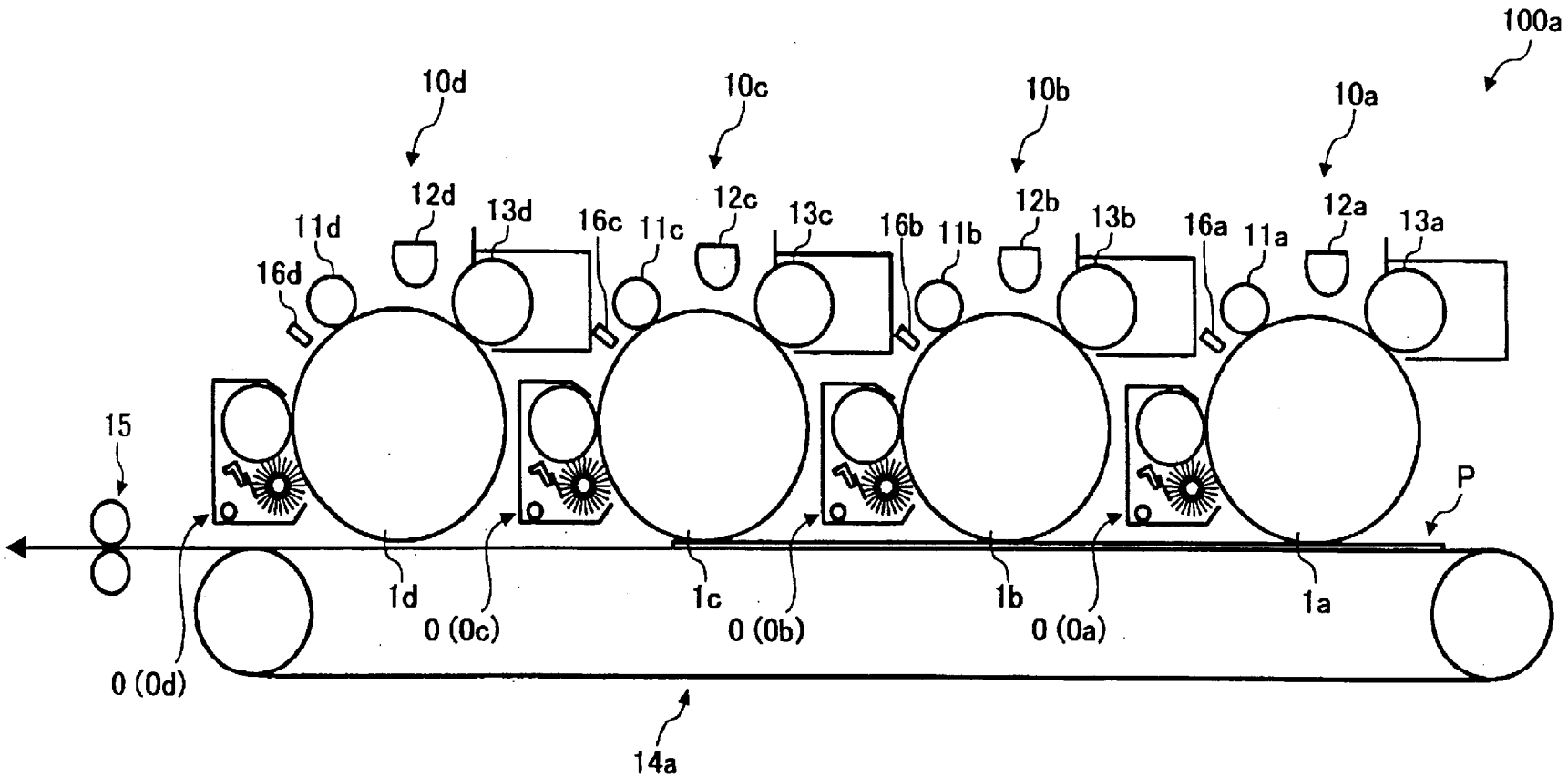
FIG. 12 is a view showing another specific configuration of the image forming apparatus including the cleaning device of the illustrative embodiment.

FIG. 12 shows a tandem, color image forming apparatus 100*a* to which the cleaning device 10 is applied. As shown, the tandem, color image forming apparatus 100*a* includes a yellow image forming unit 10*a*, a magenta image forming unit 10*b*, a cyan image forming unit 10*c* and a black image forming unit 10*d* arranged side by side along an endless belt 14*a*.

The yellow image forming unit 10*a* includes an image carrier 1*a*, a charger 11*a*, a latent image forming device 12*a*, a developing device 13*a*, a cleaning device 0*a*, and a discharger 16*a*. The other image forming units 10*b*, 10*c* and 10*d* are identical in construction with the yellow image forming unit 10*a*. The components of the image forming units lob, 10*c* and 10*d* are simply distinguished from the components of the image forming unit 10*a* by letters b, c and d, respectively, and will not be described specifically in order to avoid redundancy.

Toner images formed by the four consecutive image forming units 10*a* through 10*d* are transferred to the sheet P being conveyed by the belt 14*a* one above the other, completing a full-color image. At this instant, a preselected voltage for image transfer is applied to the belt 14*a*. The fixing device 15 fixes the full-color image on the sheet P. Of course, the order of yellow, magenta, cyan and black shown and described is only illustrative.

The color image forming apparatus 100*a* was found to enhance efficient image transfer under the previously stated conditions. Specifically, the toner to be dealt with by the cleaning devices 0*a* through 0*d* was implemented as spherical, dry grains containing at least denaturated polyester with a urea bond as a toner binder. Wax was finely dispersed in each toner grain. The surface of a fixing member contacting a toner image, which was expected to have a gloss of 5% to 30%, had a surface temperature of 50° or above.

The color image forming apparatus 100*a* with the cleaning devices 0*a* through 0*d* obviated defective cleaning. Further, because a stress to act on the toner due to cleaning was light enough to obviate wax filming on the drum 1, toner images were free from dust-like defects despite that the apparatus 100*a* needed four consecutive times of image transfer. The apparatus 100*a* therefore insures high-quality images with a compact configuration at low cost.

In summary, it will be seen that the present invention provides a cleaning device capable of fully removing toner left on an image carrier after the transfer of a toner image from the image carrier to a sheet or recording medium. This advantage is achievable despite the use of spherical, dry toner grains capable of forming a high-quality image. The cleaning device implements a small size, low cost, color image forming apparatus free from defective images of the type using spherical, dry toner grains.

Various modifications will become possible for those skilled in the art after receiving the teachings of the present disclosure without departing from the scope thereof.

What is claimed is:

1. A cleaning device comprising:

a rotatable cleaning roller configured to contact an image carrier to remove a toner on said image carrier, the cleaning roller configured to have one of a positive and a negative charge; and a rotatable brush roller configured to be positioned upstream of said cleaning roller in a direction of rotation of the image carrier and configured to contact a surface of said image carrier and a surface of said cleaning roller, the brush roller configured to have a charge opposite to the charge of the cleaning roller.

2. The cleaning device as claimed in claim 1, wherein one of the rotatable cleaning roller and the rotatable brush is configured to remove the toner having spherical, dry toner grains.

3. The cleaning device as claimed in claim 2, wherein one of the rotatable cleaning roller and the rotatable brush is configured to remove the toner containing denaturated polyester as a toner binder and contains wax.

4. The cleaning device as claimed in claim 3, wherein said cleaning roller comprises an elastic, conductive layer.

5. The cleaning device as claimed in claim 4, wherein said cleaning roller comprises a medium resistance layer on the surface.

6. The cleaning device as claimed in claim 5, wherein said cleaning roller comprises a surface protection layer formed on said medium resistance layer.

7. The cleaning device as claimed in claim 1, wherein one of the rotatable cleaning roller and the rotatable brush is configured to remove the toner containing denaturated polyester as a toner binder and contains wax.

8. The cleaning device as claimed in claim 1, wherein said cleaning roller comprising an elastic, conductive layer.

9. The cleaning device as claimed in claim 1, wherein said cleaning roller comprises a medium resistance layer on the surface.

10. The cleaning device as claimed in claim 1, wherein said cleaning roller comprises a surface protection layer on the surface.

11. The cleaning device as claimed in claim 1, further comprising a scraper blade configured to scrape off the toner collected by said brush roller.

12. A cleaning device for removing toner left on an image carrier after transfer of a toner image from said image carrier to a recording medium, said cleaning device comprising:

a rotatable cleaning roller contacting the image carrier to remove the toner left on said image carrier; and a rotatable brush roller positioned upstream of said cleaning roller in a direction of rotation of the image carrier and rubbing against a surface of said image carrier and a surface of said cleaning roller, wherein the toner comprises spherical, dry toner grains that contain denaturated polyester as a toner binder and wax, wherein said cleaning roller comprises:

an elastic, conductive layer, a medium resistance layer on the surface, and a surface protection layer formed on said medium resistance layer, and wherein said cleaning roller rotates in a direction opposite to a direction of rotation of the image carrier.

13. The cleaning device as claimed in claim 12, wherein said brush roller rotates in a direction opposite to a direction of rotation of said cleaning roller and in a same direction as the image carrier.

14. The cleaning device as claimed in claim 13, further comprising:

a scraper blade configured to scrape off the toner collected by said brush roller.

15. The cleaning device as claimed in claim 14, wherein said scraper blade comprises a sheet.

16. The cleaning device as claimed in claim 14, wherein said scraper blade has a flat edge penetrating into said brush roller.

17. The cleaning device as claimed in claim 14, wherein said scraper blade has a rugged edge penetrating into said brush roller.

18. The cleaning device as claimed in claim 14, wherein said scraper blade has a saw-toothed edge penetrating into said brush roller.

19. The cleaning device as claimed in claim 14, wherein said scraper blade penetrates into said brush roller in a trailing direction with respect to the direction of rotation of said brush roller.

20. The cleaning device as claimed in claim 14, wherein said scraper blade penetrates into said brush roller in a leading direction with respect to the direction of rotation of said brush roller.

21. A cleaning device for removing toner left on an image carrier after transfer of a toner image from said image carrier to a recording medium, said cleaning device comprising:

a rotatable cleaning roller contacting the image carrier to thereby remove the toner left on said image carrier; and a rotatable brush roller positioned upstream of said cleaning roller in a direction of rotation of the image carrier and rubbing against a surface of said image carrier and a surface of said cleaning roller, wherein said cleaning roller rotates in a direction opposite to a direction of rotation of the image carrier.

22. A cleaning device for removing toner left on an image carrier after transfer of a toner image from said image carrier to a recording medium, said cleaning device comprising:

a rotatable cleaning roller contacting the image carrier to thereby remove the toner left on said image carrier; and a rotatable brush roller positioned upstream of said cleaning roller in a direction of rotation of the image carrier and rubbing against a surface of said image carrier and a surface of said cleaning roller, wherein said brush roller rotates in a direction opposite to a direction of rotation of said cleaning roller and in a same direction as the image carrier.

23. An image forming apparatus comprising:

a rotatable image carrier;

a charger for configured to uniformly charge a surface of said image carrier; a latent image forming device configured to form a latent image on the charged surface of said image carrier;

a developing device configured to deposit toner on the latent image to thereby produce a corresponding toner image;

an image transferring device configured to transfer the toner image from said image carrier to a recording medium; and a cleaning device configured to remove the toner left on said image carrier after transfer of the toner image to the recording medium, said cleaning device comprising:

a rotatable cleaning roller contacting said image carrier and configured to remove the toner on said image carrier, the cleaning roller configured to have one of a positive and a negative charge; and a rotatable brush roller positioned upstream of said cleaning roller in a direction of rotation of said image carrier and configured to contact a surface of said image carrier and a surface of said cleaning roller, the brush roller configured to have a charge opposite to the charge of the cleaning roller.

24. An image forming apparatus comprising:

a rotatable image carrier;

a charger configured to uniformly charge a surface of said image carrier;

a latent image forming device configured to form a latent image on the charged surface of said image camera;

a developing device configured to deposit toner on the latent image to produce a corresponding toner image;

an image transferring device configured to transfer the toner image from said image earner to a recording medium; and a cleaning device configured to remove the toner left on said image carrier after transfer of the toner image to the recording medium, said cleaning device comprising:

a rotatable cleaning roller contacting said image carrier to remove the toner left on said image carrier; and a rotatable brush roller positioned upstream of said cleaning roller in a direction of rotation of said image carrier and rubbing against a surface of said image carrier and a surface of said cleaning roller, wherein said image carrier, said charger, said latent image forming device, said developing device, said image transferring device and said cleaning device are constructed into a single image forming unit.

25. The apparatus as claimed in claim 24, wherein said image forming unit comprises at least two image forming units for forming a color image.

* * * * *